US007002070B2

(12) United States Patent
Katz

(10) Patent No.: US 7,002,070 B2
(45) Date of Patent: Feb. 21, 2006

(54) ELECTRONIC PIANO

(76) Inventor: Shelley Katz, 30 The Ridgeway, Herstmonceux, East Sussex (GB) BN27 4BQ ( * ) Notice: Subject to any disclaimer, the term of this patent is extended or adjusted under 35 U.S.C. 154(b) by 0 days.

(21) Appl. No.: 10/178,149

(22) Filed: Jun. 24, 2002

(65) Prior Publication Data

US 2003/0015086 A1 Jan. 23, 2003

Related U.S. Application Data

(60) Provisional application No. 60/300,119, filed on Jun. 22, 2001.

(51) Int. Cl.
*G10H 1/32* (2006.01)

(52) U.S. Cl. ..... 84/718; 84/600; 84/644; 84/719; 84/743; 84/744

(58) Field of Classification Search ..... 84/600, 84/615, 622, 644, 718–721, 723, 725–726, 84/730–731, 735, 743–746
See application file for complete search history.

(56) References Cited

U.S. PATENT DOCUMENTS

| | | | | |
|---|---|---|---|---|
| 3,178,512 A | | 4/1965 | Ashworth | |
| 3,334,195 A | | 8/1967 | Ashworth | |
| 3,449,531 A | | 6/1969 | Ashworth | |
| 3,509,282 A | | 4/1970 | Ashworth | |
| 4,151,379 A | | 4/1979 | Ashworth | |
| 4,718,098 A | | 1/1988 | Ashworth | |
| 5,058,173 A | | 10/1991 | Ashworth | |
| 5,247,129 A | * | 9/1993 | Nozaki et al. | 84/615 |
| 5,287,413 A | | 2/1994 | Ashworth | |
| 5,706,358 A | | 1/1998 | Ashworth | |
| 5,864,080 A | | 1/1999 | O'Connell | |
| 5,981,861 A | * | 11/1999 | Van Delinder et al. | 84/743 |
| 6,351,542 B1 | | 2/2002 | Azima et al. | |
| 6,399,870 B1 | * | 6/2002 | Azima et al. | 84/744 |
| 2003/0015086 A1 | | 1/2003 | Katz | |

FOREIGN PATENT DOCUMENTS

| | | |
|---|---|---|
| DE | 200 02 930 U1 | 6/2000 |
| GB | 2 368 484 A | 5/2002 |

(Continued)

OTHER PUBLICATIONS

"Cyrus Launches Revolutionary New Planar Loudspeaker System", Cyrus Icon, published Mar. 2001. Press Release.

(Continued)

*Primary Examiner*—Marlon T. Fletcher
(74) *Attorney, Agent, or Firm*—Cohen, Pontani, Lieberman & Pavane

(57) ABSTRACT

An electronic piano is provided in which activation of a keyboard (7) and foot pedals (8) causes sound to be generated and output via a pair of conventional cone loudspeakers (210–212) each comprising a tweeter (214), a woofer (216) and a base (218). Simultaneously with the activation of the conventional cone loudspeakers (210, 212), sound corresponding to the notes played by using the keyboard (7) is also generated and output via two distributed mode loudspeakers (220, 222) which are arranged to output sound through the inducement of resonant vibrations. The conventional cone loudspeakers (210–212) act as a series of discrete point sound sources. The distributed mode loudspeakers (220, 222) act as diffuse point sources generating sound across the entire surface area of the panels (220, 222). The air disturbance patterns propagated by the two different types of sound source result in sound more closely emulating the sound generated by a conventional high quality acoustic grand piano.

3 Claims, 12 Drawing Sheets

FOREIGN PATENT DOCUMENTS

| | | |
|---|---|---|
| JP | 08050479 | 2/1996 |
| JP | 10288987 | 10/1998 |
| WO | WO 97/09842 | 3/1997 |
| WO | WO 98/39947 | 9/1998 |
| WO | WO 00/22877 | 4/2000 |
| WO | WO 00/36586 | 6/2000 |
| WO | WO 00/67524 | 11/2000 |
| WO | WO 01/39541 A2 | 5/2001 |

OTHER PUBLICATIONS

Henry Azima, "NXT Up Against the Wall", Hachette Filipacchi Magazines, 1998.
Neil Harris, "The Distributed-Mode Loudspeaker (DML) as a Broad-Band Acoustic Radiator", AES 4526 (D-6), pp. 1-8.
Henry Azima et al., "Boundary Interaction of Diffuse Field Distributed-Mode Radiators", AES 4635 (K-6), pp. 1-12.
Joerg W. Panzer, "Distributed Mode Loudspeaker Simulation Model", AES, 4739 (P7-9), pp. 1-11.
Joerg Panzer et al., "Distributed-Mode Loudspeaker Radiation Simulation", AES, 4783 (G-1), pp. 1-13.
Henry Azima, "NXT—A Technical Overview", www.nxtsound.com/technology/white paper technical 1./htm.
Gunilla Berndtsson et al., "A room acoustic experiment with an artificial reverberation system using wooden loudspeakers", acta acustica 2, pp. 37-48, (1994).
Gunilla Berndtsson, "Acoustical Properties of Wooden Loudspeakers Used in an Artificial Reverberation System", Applied Acoustics 44, pp. 7-23 (1995).
Naqvi et al., "The Active Listening Room Simulator: Part 1", Audio Engineering Society Convention Paper 5385 presented at the 110th Convention May 12-15, 2001, Amsterdam, The Netherlands.
Naqvi et al., "The Active Listening Room Simulator: Part 2", Audio Engineering Society Convention Paper 5425 presented at the 111th Convention Sep. 21-24, 2001, New York, NY, USA.
Naqvi et al., "The Active Listening Room Simulator: Part 3, A Subjective Analysis", Audio Engineering Society Convention Paper 5585 presented at the 112th Convention May 10-13, 2001, Munich, Germany.

* cited by examiner

ELECTRONIC PIANO

This application claims the benefit of U.S. Provisional Application No. 60/300,119 filed 22 Jun. 2001.

This invention relates to electronic keyboard instruments. In particular, this invention relates to electronic pianos.

In a conventional acoustic piano, when a key is depressed this causes a hammer to strike a string or strings whose vibrations generate a note. The pitch of the note is primarily dependent upon which string or strings are struck. However, the actual sound generated is determined by the interaction of structural features of the entire instrument and is dependent on factors including the materials from which the piano is made, the use of the foot pedals, the other strings which may be vibrating at the same time and exactly how the musician has pressed the key.

In a digital electronic piano, when the keys are depressed by a musician, this is detected and the signals generated are used to cause a digitally stored sound signal to be modified to correspond to the sound of a note played in the manner indicated by the detected depression of keys. A sound corresponding to the modified signal is then reproduced through a loudspeaker.

The difference in the quality of sound generated by known electronic pianos compared with the quality of sound generated by a good grand piano, such as a Steinway (Trade Mark) or Bosendorfer (Trade Mark), is very significant. The present invention aims to provide an electronic piano which can generate a quality of sound closer to that of a good acoustic grand piano.

The present invention also aims in a preferred embodiment to provide a digital piano which has much more of the "feel" of a conventional acoustic grand piano than does a conventional electronic piano In particular, a digital piano of the present invention aims to generate a sound which closely emulates the spatial qualities of a conventional grand piano.

In accordance with one aspect of the present invention there is provided:

an electronic instrument comprising:

a keyboard comprising keys corresponding to musical notes;

a signal generator connected to the keyboard and responsive to actuation of the keyboard to generate corresponding driving signals;

a first sound production unit connected to the signal generator, and responsive to the driving signals of the signal generator to produce sound corresponding to the musical notes, said first sound production unit comprising a panel loudspeaker and at least one transducer responsive to the audio signals to induce resonant vibrations in the panel loudspeaker; and a second sound production unit connected to the signal generator and responsive simultaneously with said first sound production unit to the driving signals of the signal generator to produce sound corresponding to the musical notes, said second sound production unit comprising at least one cone loudspeaker.

In accordance with a further aspect of the present invention there is provided an electronic piano comprising:

a keyboard for generating input signals;

an acoustic signal generator for generating audio signals in response to said input signals;

sound generating means connected to said acoustic signal generator, said sound producing means comprising a panel arranged to generate sound through the inducement of resonant vibrations in said panel; and support means operable to support said keyboard, said signal generator and said sound producing means in cooperable relationship, wherein said support means is such as to transmit vibrations generated by said panel to said keyboard.

In accordance with another aspect of the present invention there is provided a kit of parts comprising:

a first housing carrying a keyboard and an audio signal generation system and first sound output means; and a second housing carrying a second sound output means, said second sound output means being adapted to output sound by the inducement of resonant bending mode vibrations within a panel arranged substantially horizontally within said second housing, wherein said second and first housings when attached adopt the configuration of a grand piano.

In accordance with a further aspect of the present invention there is provided a method of emulating air disturbance patterns characteristic of an acoustic grand piano comprising the steps of:

providing a panel having a plurality of transducers attached thereto;

supporting said panel substantially horizontally within a casing having the configuration of a grand piano; and inducing bending mode vibrations in said panel utilizing said transducers to generate a sound corresponding to an audio signal representative of the sound of a grand piano.

Further aspects of the present invention will become apparent from the description and the accompanying drawings, in which.

Figure 1:
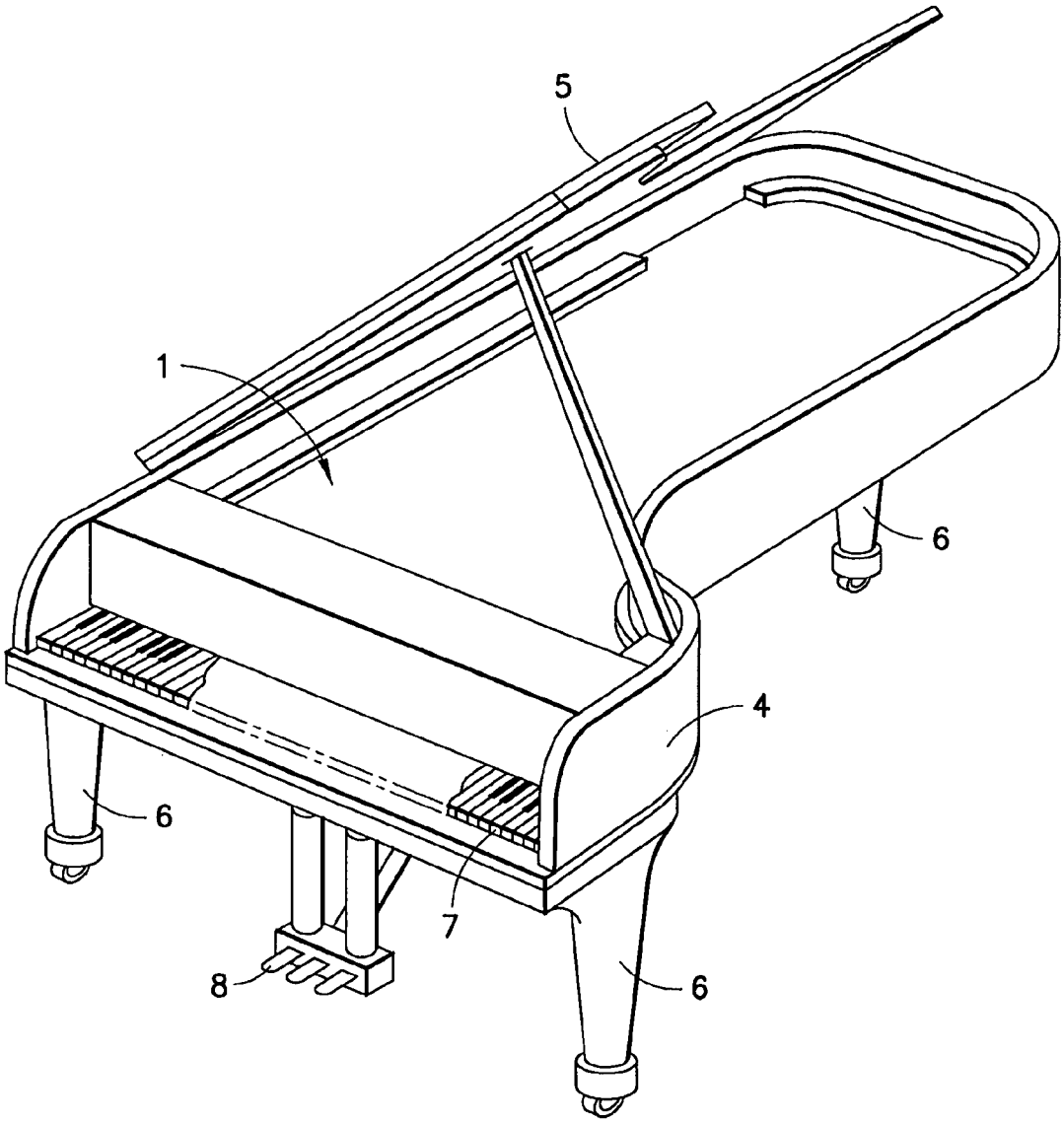
FIG. 1 is a perspective view of a digital piano in accordance with the first embodiment of the present invention.

Each of the following embodiments utilises one or more distributed mode loudspeakers of the kind described in U.S. Pat. No. 6,399,870 and published international Application WO97/09842, the contents of both of which are hereby incorporated herein by reference. As is explained, particularly in the above U.S. patent, a distributed mode loudspeaker comprises a member having selected values of certain physical parameters which enable the member to sustain and propagate input vibrational energy in a predetermined frequency range by a plurality of resonant bending wave modes in at least one operative area extending transversely of thickness such that the frequencies of the resonant bending wave modes along at least two conceptual axes of the operative area are interleaved and spread so that there are substantially minimal clusterings and disparities of spacings of said frequencies, the member when resonating having at least one site at which the number of vibrationally active resonance anti-nodes is relatively high; and a transducer mounted wholly and exclusively on the member at one of said sites on the member, the transducer being capable of vibrating the member in the predetermined frequency range to couple to and excite the resonant bending wave modes in the member and cause the member to resonate and produce an acoustic output.

References to the distributed mode loudspeaker in the following description of the embodiment of the invention shown in the accompanying drawings should be understood as a reference to a loudspeaker as defined in the preceding paragraph.

First Embodiment

In the digital piano of FIG. 1 having a sound selection and generation system as is described later, the piano comprises a conventional grand piano such as a Steinway or Bosendorfer in which the harp comprising strings in a supporting framework and soundboard of the piano have been replaced by a panel 1. In this embodiment the panel 1 is arranged to be excited by a plurality of transducers (not shown in FIG. 1) in the manner described in WO097/09842 or U.S. Pat. No. 6,399870, so as to constitute a distributed mode loudspeaker. As in a conventional grand piano, the piano comprises a casing 4 and lid 5 that are supported away from the ground by a plurality of legs 6. Carried on the casing 4 are a conventional grand piano keyboard 7 connected to a mechanical piano action (not shown in FIG. 1) and a set of three foot pedals 8. The panel 1 is shaped to fit within the casing 4 and extends across the entirety of the area bounded by the casing 4. In this embodiment in which the casing 4 corresponds in size and shape to a baby grand piano, the panel 1 extends for 2020 mm away from the keyboard and is shaped having a width of 1235 mm adjacent to the keyboard 7 and narrowing to a width of 590 mm a distance of 340 mm from the edge adjacent to the keyboard 7 with the periphery of the panel 1 following the shape of the area bounded by the casing 4.

Beneath the keys of the keyboard 7 there is provided an infrared motion detection system for detecting the depression the keys. The foot pedals 8 are connected to switches (not shown in FIG. 1). The detected combination of the motions of the keys of the keyboard 7 and the depression of the foot pedals 8 is received by a high quality sound selection and generation system (not shown in FIG. 1) provided within the casing 4 behind the keyboard 7. The sound selection and generation systems then generate an appropriate acoustic sound signal which is reproduced by the panel 1 as is described in detail below.

Figure 2:
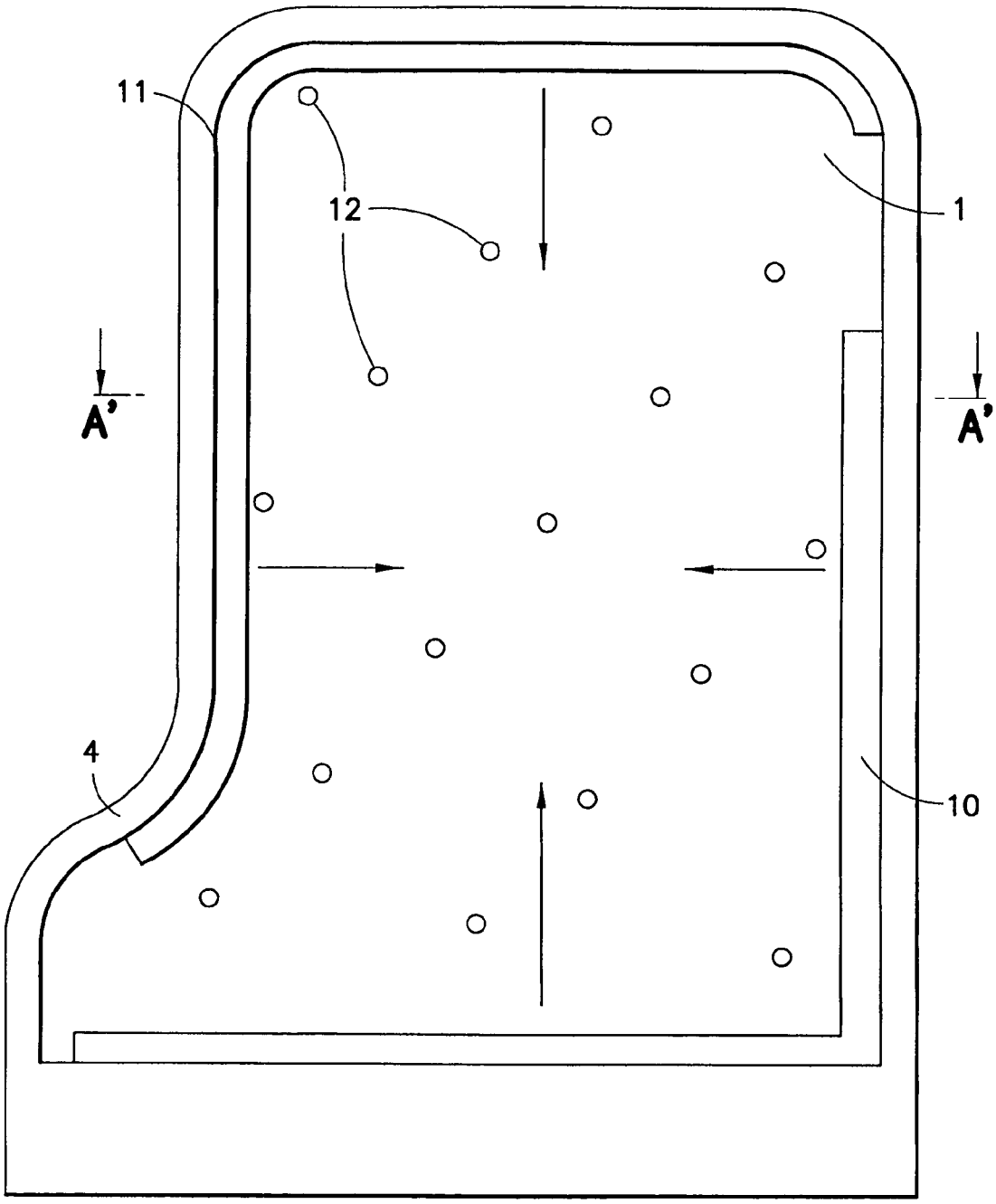
FIG. 2 is an underneath plan view of the piano of FIG. 1.

FIG. 2 is a schematic underneath plan view of the piano of FIG. 1, and illustrates how the panel 1 is connected to the casing 4. As is shown in FIG. 2, the panel 1 is held in place against the casing 4 by a pair of wooden clamps 10,11 at the periphery of the panel 1. The clamps 10,11 each comprise an upper portion situated above the panel 1 (not shown in FIG. 2) and a lower portion beneath the panel 1. One of the clamps 10 extends along the entirety of the edge of the panel 1 along the side adjacent to the portion of the edge of the casing 4 closest to the keyboard. This clamp 10 also extends along part of the long edge of the piano casing 4 with a portion of the panel 1 adjacent to the casing 4 remote from the keyboard 7 being allowed to vibrate freely. The other clamp 11 extends along the curved edge of the grand piano casing 4 A portion of the panel 1 adjacent to the short edge of the grand piano casing 4 is also allowed to vibrate freely.

In this embodiment, the panel 1 is arranged to be compressed by the casing 4 when held in place by the clamps 10,11, with the casing 4 horizontally compressing the panel 1 in the directions indicated by the arrows in FIG. 2. By fixing the panel 1 via clamps 10,11 to part of the casing 4 and causing the panel 1 to be horizontally compressed by the casing 4 it is possible to ensure that some of the vibrations created within the panel 1 are transmitted to the casing 4 to give rise to vibrations in the casing 4 in a similar manner to the way in which vibrations from an acoustic soundboard give rise to vibrations in the casing of a conventional acoustic grand piano.

Also shown in FIG. 2, arranged on the undersurface of the panel 1 are sixteen transducers 12 such as the 25 mm voice coil exciter transducers available from Peerless Fabrikkern A/S which are used to induce vibrations in the panel 1. The arrangement shown in FIG. 2 is merely a schematic representation of the actual arrangement of transducers on the panel 1. Preferably, the arrangement of transducers 12 on the panel 1 is an arrangement in accordance with a determination by a finite element analysis of an optimum arrangement of transducers so that vibrations excited in the panel 1 correspond to vibrations excited in the soundboard of a grand piano over the entire working frequency range of the instrument. When a drive signal is then transmitted to these transducers 12 via wires (not shown) this causes the panel 1 to vibrate in a manner similar to a grand piano soundboard as is described later.

Figure 3:
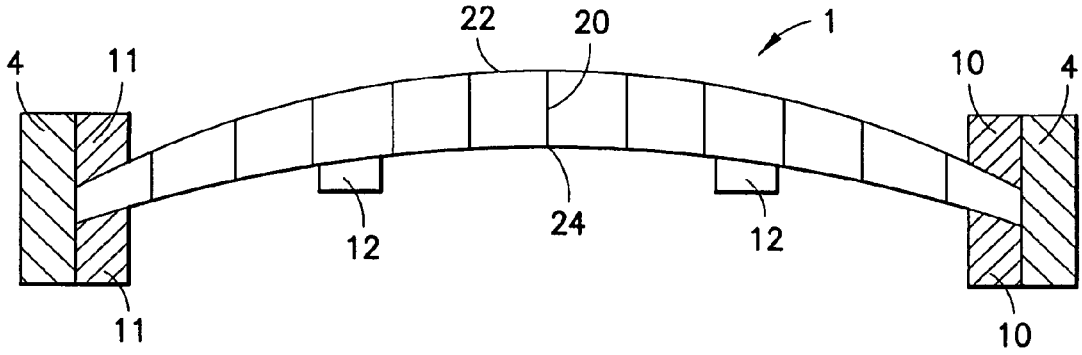
FIG. 3 is a cross-section along the line A–A' of FIG. 2.
Figure 4:
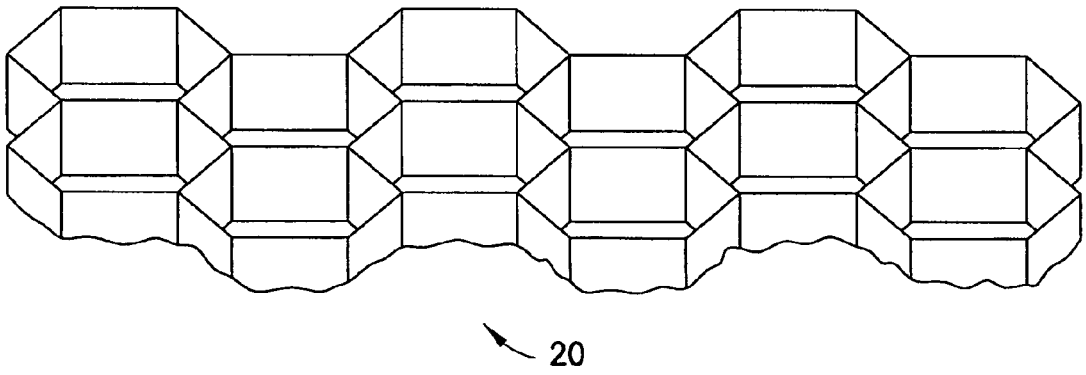
FIG. 4 is an illustration of an internal honeycomb structure of a panel.

FIG. 3 is a vertical cross-section through the panel 1 along the line A–A' in FIG. 2. In this embodiment of the present invention the panel 1 comprises a shaped panel 1 having an internal honeycomb structure 20 (which is illustrated in FIG. 4) and a pair of outer skins 22,24. In this embodiment, the honeycomb structure 20 comprises paper covered by phenolic resin, and the outer skins 22,24 comprise epoxy resin glass fibre skins.

Since the mass of the honeycomb 20 is much less than that of the skins 22,24 a lightweight panel 1 that is of substantially uniform density across the entirety of the panel 1 is created. This has the advantage of presenting an isotropic and homogenous acoustic impedance to transverse (bending mode) vibrations conducted through the panel 1. Furthermore, since the panel is of uniform density it is also possible to model the vibrations generated by the transducers 12 accurately to determine the optimum positions for the transducers 12 to achieve uniform output across the frequency range of a grand piano. This can be achieved by identifying the points on the panel corresponding to nodes when the panel is excited to vibrate at different frequencies and locating the transducers at points corresponding to nodes. The energy required to induce vibrations in the panel 1 via the transducers 12 is then minimised by ensuring that the panel 1 is lightweight.

In this embodiment the panel 1 is shaped to vary in thickness from a peripheral thickness of about 5 mm to a central thickness of about 15 mm. The shaping of the panel 1 is achieved by cutting the internal honeycomb structure 20 to shape by laser cutting or using an ultrasonic knife prior to the attachment of the glass fibre skins 22,24.

As stated previously, in this embodiment the casing 4 and clamps 10,11 are such as to place the panel 1 slightly under horizontal compression to ensure that the edges of the soundboard communicate vibrations generated to the casing 4. This horizontal compression exerted by the casing 4 is such to cause the panel 1 to adopt a slightly cambered orientation with the undersurface of the board adjacent to the casing 4 being at an angle of between 2 to 5o from the horizontal. In this way the panel 1 is arranged to adopt a shape that is similar to the shape of a conventional acoustic soundboard and therefore when excited by the transducers 12 the panel 1 generates an air disturbance pattern similar to that generated by a conventional acoustic grand piano.

Figure 5:
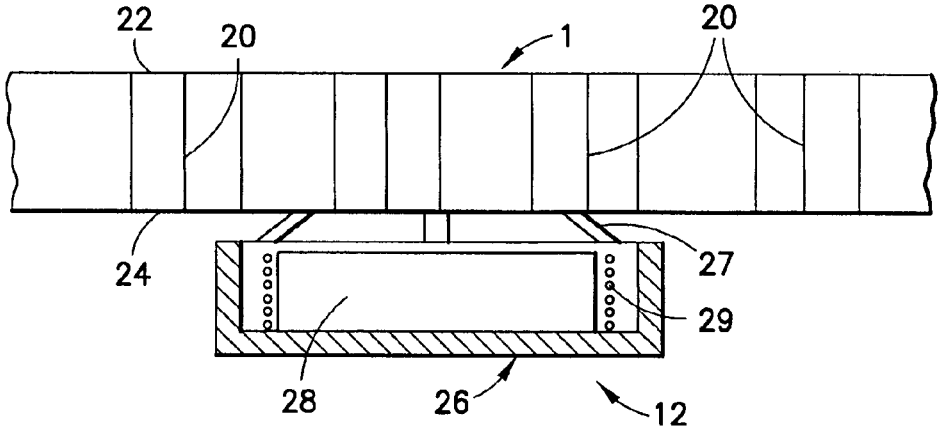
FIG. 5 is a cross-sectional of a transducer attached to a panel.

FIG. 5 is a detailed cross-section of a transducer 12 connected to a portion of the panel 1. In this embodiment all of the transducers 12 for inducing vibrations in the panel 1 are attached to the underside of the panel 1. Each of the transducers 12 comprises a steel outer casing 26 weighing about 50 grams that it attached to the panel 1 via a plurality of arms 27 that are glued to the panel 1 by cynoacrylate glue. Inside the casing 26 of each transducer 12, is a cylindrical rare earth cobalt iron magnet 28 attached to the casing 26, with the magnet 28 being surrounded by a copper wire coil 29. The arms 29 are arranged to flex allowing limited axial movement of the casing 26 relative to the panel 1 with the coil 29 fixed in position relative to the surface of the panel 1. When the copper wire coil 29 receives a drive signal this causes the magnet 28 to vibrate flexing the arms 27. The panel 1 moves in an opposite direction to account for the motion of the magnet 28 and casing 26, inducing bending moment vibrations within the panel 1.

Inducing vibrations in the panel 1 using transducers 12 creates air disturbance patterns similar to those created in an acoustic grand piano soundboard. In particular in an acoustic grand piano soundboard the mechanical vibrations of the strings induce vibrations in the soundboard which are at right angles to the surface of the soundboard. This causes pressure waves to radiate from the surface of the soundboard which are reflected by and induce vibrations in the casing surrounding the soundboard. The interaction of the soundboard and casing is such as to give rise to soundwaves which predominantly travel upwardly and downwardly which are then reflected by the lid 5 and ground respectively. The soundwaves also induce vibrations in the casing which is perpendicular to the soundboard. Together, these combine to cause the generation of air disturbance patterns characteristic of a grand piano. In the present embodiment a comparable effect is achieved by inducing bending mode vibrations in a panel 1 which vibrates primarily upwardly and downwardly but also which vibrates in the plane of the panel 1. Soundwaves generated in the surrounding air by the vibrating panel 1 then travel upwardly and downwardly in a similar manner to those generated by a conventional acoustic soundboard, with the soundwaves being reflected by the lid 5 and ground whilst vibrations in the plane of the panel 1 are at the same time transmitted to the casing 4 as the panel 1 is in pressure contact with the casing. By providing a casing 4 shaped to correspond to the shape of a conventional piano casing these combine to generate an air disturbance pattern comparable to that generated by an acoustic grand piano.

By providing the panel 1 in the position where the harp and soundboard of a conventional acoustic grand piano would be it is possible to emulate more closely the spacial aspects of sound generated by an acoustic piano. In particular, this can be achieved by having a plurality of transducers 12 generate sound from the entirety of the surface of a panel 1 rather than providing a sound source comprising a number of point sources. This combined with the generation of soundwaves both upwardly and downwardly generates an acoustic directivity pattern which is similar to the acoustic directivity pattern of sounds generated by striking the strings of a conventional acoustic grand piano.

Figure 6:
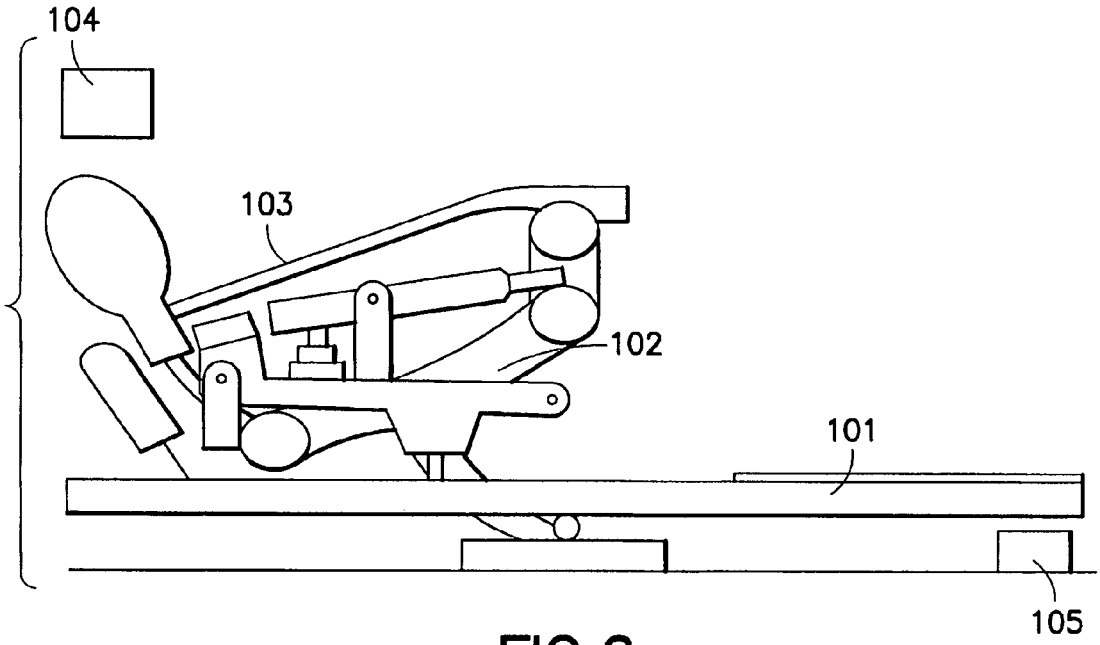
FIG. 6 is a diagram of the piano action and key depression detection system of the digital piano of FIG. 1.

With reference to FIG. 6, each of the keys 101 of the keyboard 7 is connected via an action mechanism 102 to a hammer 103. This embodiment of the invention preferably utilises a high quality conventional grand piano action mechanism for transmitting the movement of the keys to the hammers each time a key is depressed in order to provide for the player a feel which closely resembles the feel of a good quality grand piano. Ideally, therefore, the action used is the same as that used in a conventional grand piano such as the Steinway or Bosendorfer. The hammer 103 and action mechanism 102 are arranged so that when a musician strikes a key 101 the hammer is caused to strike a sound absorbing material such as a rubber strip 104. An infrared pickup 105 such as one of the pick ups of the Gabor system (Trade Mark) touch sensitive pick-up switch strips manufactured by GB Musical Enterprises Limited, is arranged beneath each of the keys of the keyboard 7 to detect each time a key is depressed.

By providing a keyboard 7 having an action 102 that causes hammers to be moved, the digital piano of this embodiment has a feel similar to a conventional piano. The detection of movement by the infrared pick-up 105 does not influence how the keyboard feels to the player since the infrared pickup 105 can detect the motion of the keys without mechanical interference with the motion of the action 102 The hammers 103 are arranged to strike a sound absorbing strip 104 so that the sound generated by the motion of the hammer 103 is minimised and hence does not detract from the sound generated by the panel 1.

Figure 7:
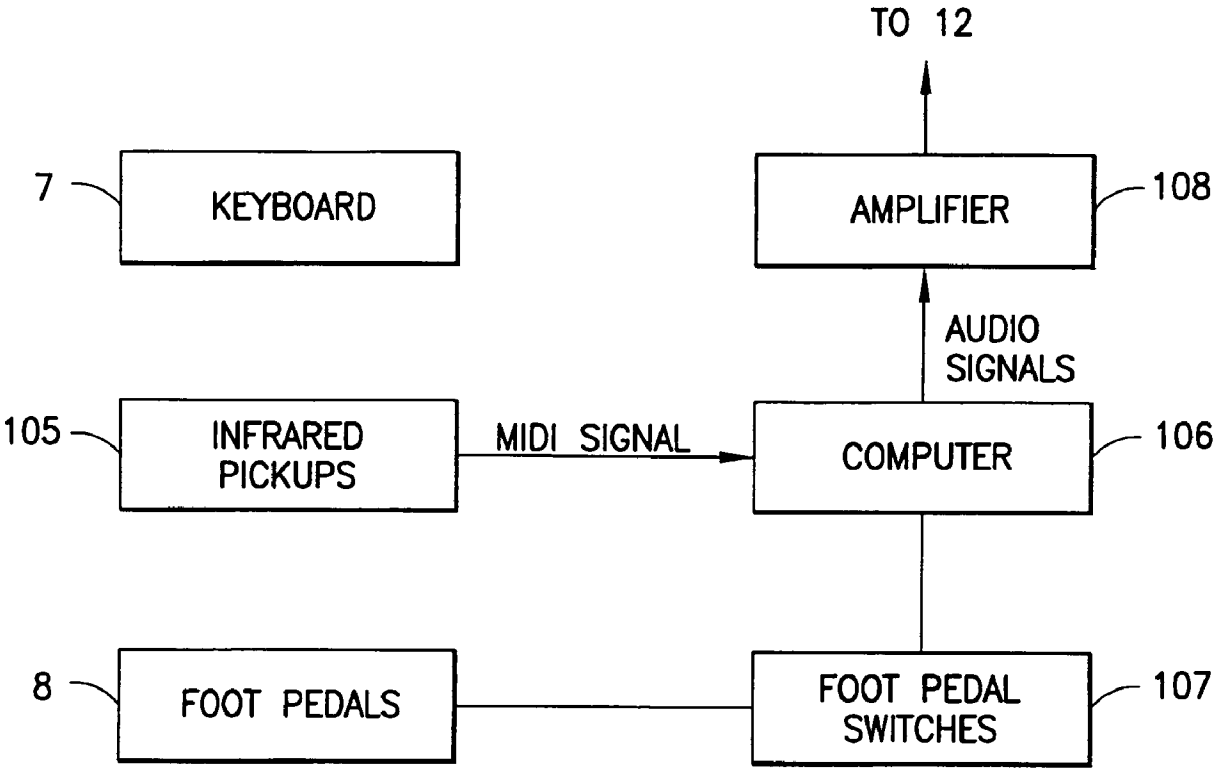
FIG. 7 is a block diagram of the sound selection system of the digital piano of FIG. 1.

FIG. 7 is a block diagram of the sound selection system of digital piano of FIG. 1. The sound selection system comprises a computer 106 which is connected to the infrared pickups 105 beneath the keys of the keyboard. The computer 106 is also connected via foot pedal switches 107 to the foot pedals 5 of the digital piano.

When a musician depresses the keys of the keyboard 7 the motion of the keys is detected by the infrared pickups 105 which generate a MIDI (Musical Instrument Digital Interface) signal which is sent to the computer 106. If the foot pedals 8 are depressed this causes the foot pedal switches 107 to be activated to send a signal to the computer 106 to indicate which of the damper, soft and sustain pedals is being depressed. Together, the signals received from the infrared pickups 105 and the foot pedal switches 107 provide an indication of how the piano is being played.

When a signal is received from the infrared pickups 105 and the foot pedal switches 107, the computer 106 is caused to select a sound sample corresponding to the MIDI signal received, adjusted to account for the effect of the foot pedals. A suitable computer 106 could comprise a Giga Sampler (TM) which is arranged to select instrument samples read directly from a high speed hard disc such as an IBM Ultrastar SCSI U2W9.1 Gigabyte hard drive or other mass storage device. When an appropriate sample has been selected, a sound card such as a Yamaha SW1000×GPCI Sound Card within the computer 106 generates an audio signal corresponding to the selected sample. By providing a large library of sound samples of different notes played on a conventional grand piano such as a Steinway, Bosendorfer or Yamaha, audio signals that accurately model the sound of a conventional piano can be generated for the entire range of sounds of a conventional piano.

Connected to the sound card of the computer 106 is an amplifier 108. In this embodiment the amplifier 108 comprises 700 watt single channel amplifier which amplifies the audio signal output by the computer 106. This amplified signal is then transmitted to the coils 29 of the transducers 12 attached to the panel 1 which cause the transducers 12 to generate bending mode vibrations in the panel 1 so that the vibrational energy from the transducers 12 radiates across the full extent of the panel 1, thereby causing air disturbance patterns similar to those generated by an acoustic instrument.

The applicant has appreciated that in order for a digital piano to more closely emulate the perceived spatial variations in sound which arise in an acoustic grand piano and hence more closely emulate the sound and feel of a conventional grand piano, it is necessary to replicate air disturbance patterns similar to those generated by an acoustic instrument.

The applicant has appreciated that the perceived spatial variations in the sound arise in part due to the direction in which sound waves travel. In a conventional grand piano the sound waves generated by the vibration of the sound board are of greatest magnitude in a direction perpendicular to the surface of the sound board. For a grand piano with a horizontal frame, the strings extend horizontally. In the preferred embodiments, a sound source is arranged in the plane where the harp of such a conventional grand piano would normally be found. In this way an electronic sound source is provided which mimics the action of the soundboard of a convention acoustic grand piano. It is therefore possible to emulate the apparent directional variation of the sound of a piano as well as the apparent source of the sounds generated and thereby improve the ability of a digital piano to emulate a conventional piano.

It has also been appreciated that the perceived spatial variation of a conventional piano arises from the fact that a conventional acoustic piano sound board generates sound across the entirety of its surface. Thus the sound source of the present invention is selected so as to be a diffuse sound source rather than point sound source such as a conventional loudspeaker generating vibrations in air via a pistonic action.

Furthermore, by providing a casing 4, lid 5 and legs 6 made from conventional materials and arranged in a conventional manner, the effect of the interaction of the sound waves with the casing 4, lid 5 and legs 6 should also be similar to the interactions which occur in a conventional grand piano and hence further enhance the emulation of the sound of a conventional grand piano. The fixing of the panel to the casing 4 in a similar manner to the fixing of a conventional soundboard to the casing of a conventional piano also acts to ensure that these other parts of the piano vibrate in a conventional manner. In particular the shaping of the panel 1 and the placing of the panel 1 under horizontal compression by the casing cause vibrations in the casing 4, lid 5 and keys 6 similar to those in a conventional piano. This in addition to the vibrations caused by the panel 1 being conveyed to a musician directly through the piano and via the floor in a manner similar to an acoustic piano, acts to improve the emulation of the feel of an acoustic grand piano.

A piano in accordance with this embodiment of the present invention, could be purpose built or alternatively a conventional acoustic grand piano, could be converted into a piano in accordance with this embodiment. If an acoustic piano is to be converted into a piano in accordance with this embodiment, the conversion would be performed by removing the harp and sound board of the conventional piano replacing them with a panel as has previously been described and installing equipment for detecting the depression of keys and foot pedals of the conventional piano together with a sound generation system as has also been described for generating a drive signal utilizing detected key and pedal depressions.

Second Embodiment

Figure 8:
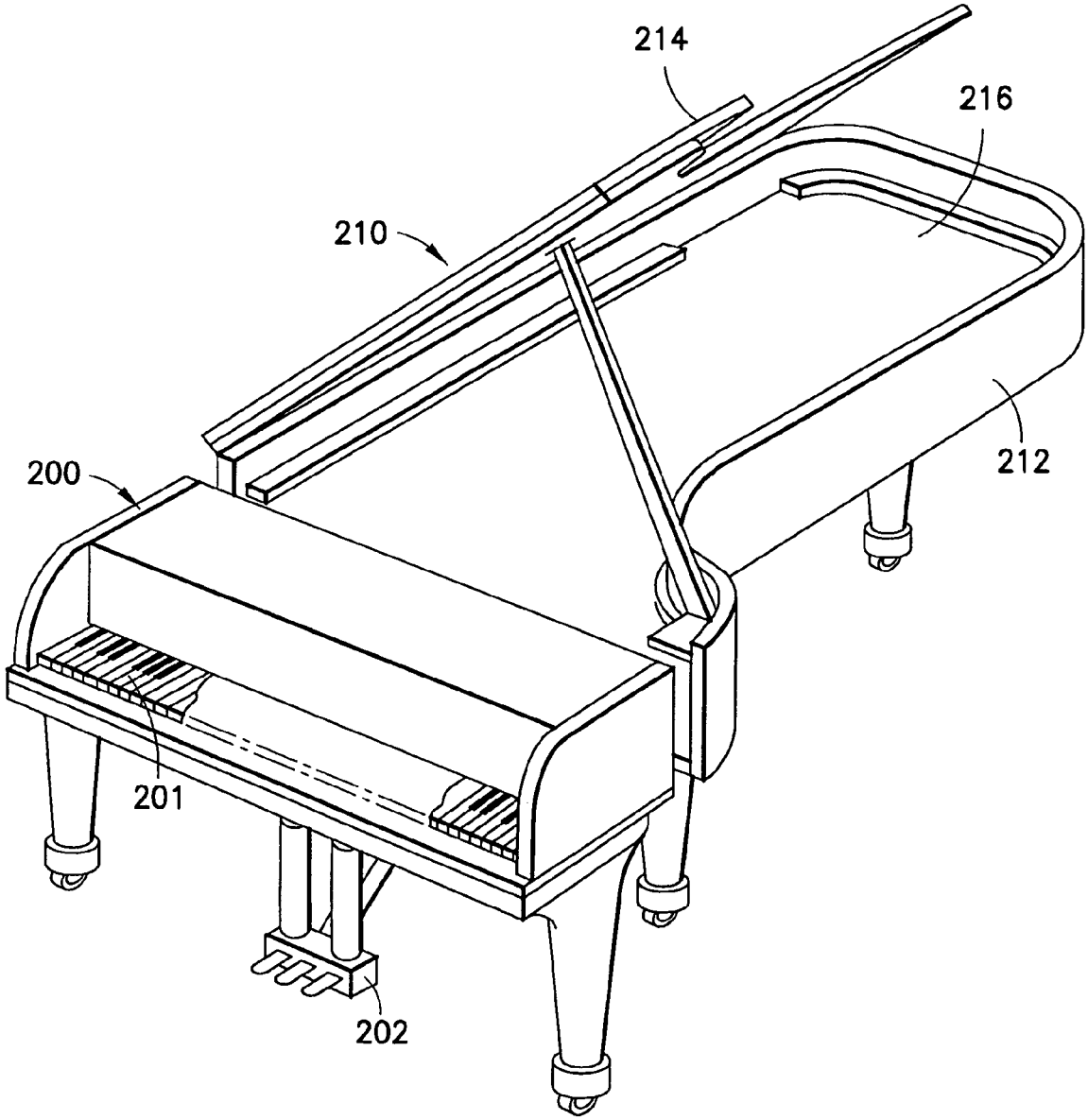
FIG. 8 is a perspective view of a digital piano in accordance with a second embodiment of the present invention.

FIG. 8 is a perspective view of a piano in accordance with a second embodiment of the present invention In the previous embodiment a digital piano was provided in which a panel 1 was held within a unitary casing 4 in which also carried a keyboard 7 and foot pedals 8. In this embodiment of the present invention a piano is provided which is divided into two parts. A first portion 200 is provided which is arranged to carry a keyboard 201, a set of foot pedals 202, a sound generation system (not shown in FIG. 8) and a conventional sound output system using loudspeakers. In accordance with this embodiment of the present invention this first portion 200 of the piano could be used in the manner of a conventional digital piano. Also provided in accordance with this embodiment of the present invention is a second portion 210 comprising a casing 212, a lid 214 and a panel 216 arranged to be excited via transducers (not shown in FIG. 8) in the manner described in relation to the first embodiment. The second portion 210 in this embodiment is shaped so that when it is attached to the first portion 200 of the pianos the combined instrument has the physical appearance of a conventional grand piano. In this embodiment the casing 212 comprises a number of separable portions allowing the casing 212 to be dismantled and flat packed.

Thus in accordance with this embodiment of the present invention the first portion of the piano 200 may be used in the manner of a conventional digital piano in the absence of the second portion 210. If, however, a sound more closely emulating a grand piano sound is required the second portion 210 of the piano can be connected to the first portion with the sound generated by the sound system of the first portion 200 being played through the panel 216 of the second section 210 with the conventional sound output system being disabled. The instrument formed by combining the first 200 and second portions 210 of a piano in accordance with this embodiment will then give rise to air disturbance patterns comparable to those generated by a grand piano since the location of the origin of the sound from the instrument and its physical shape will be comparable to that of a conventional instrument. Thus connecting the two portions of the instrument enables the piano of the first portion 200 to more closely emulate a grand piano when desired for example when performing a concert. Providing a casing 212 that is formed from a number of separable portions enables the second portion 210 to be dismantled and stored. When reassembled for use, the assembly of the second portion 210 requires fixing of the in panel 216 to the casing 212 in a manner which clamp, the panel 216 under horizontal compression using horizontal clamping forces applied by screw couplings (not shown).

Further Embodiments

Third, fourth and fifth embodiments will now be described in which the core problem of achieving realistic musical sound from digital pianos is addressed and substantially solved. In particular, as is well known, even good quality digital pianos produce a sound which is relatively unmusical. It is considered that this is due to the sound being somewhat monotonous. The third, fourth and fifth embodiments to be described all employ means by which highly enriched sounds with random components are generated with the result the listener is given the impression that the sounds produced are close in quality to the sounds of the high quality acoustic grand piano. For this purposes the third, fourth and fifth embodiments each include at least first and second different loudspeaker types for producing respectively different types of air disturbance pattern. In addition, in certain of these embodiments, two or more different sound sources are utilised derived from or modelling the sounds of two or more different models of piano.

Third Embodiment

Figure 9:
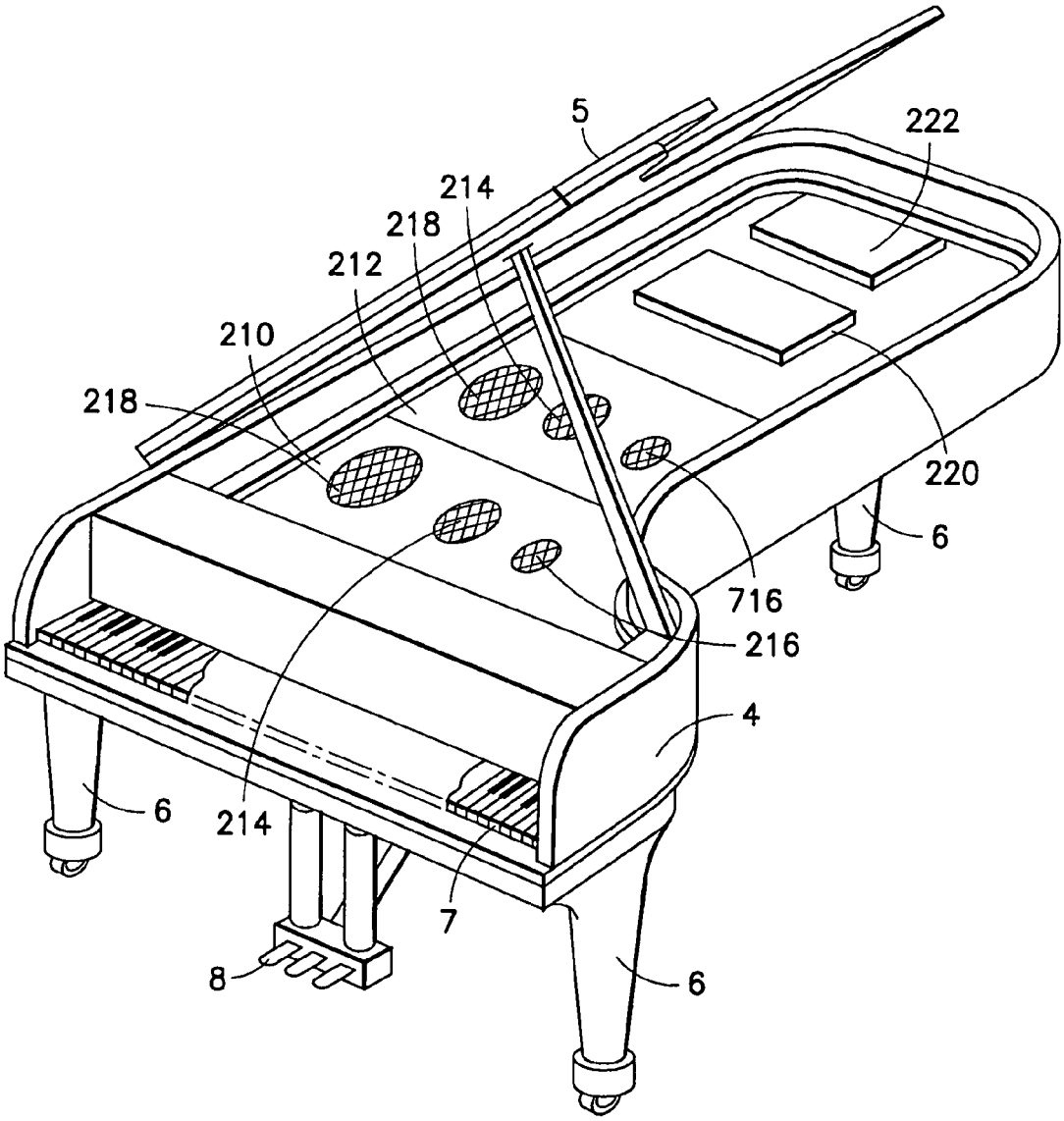
FIG. 9 is a perspective view of a digital piano in accordance with a third embodiment of the present invention.

FIG. 9 is a perspective view of a digital piano according to the third embodiment of the present invention. Those parts of the piano which correspond to parts described with reference to the earlier drawings are indicated by the same reference numbers and will not be re-described at this point.

The casing 4 supports two loudspeaker assemblies 210 and 212, each comprising a tweeter 216, a mid-range unit 214 and a sub-woofer 218, arranged respectively in alignment with the treble, mid-range and base portions of the keyboard. Each of the loudspeakers 216, 214 and 218 is a conventional electromagnetically driven cone loudspeaker arranged so that the cones face vertically upwardly and the sounds produced thereby are reflected by the lid of the piano. Although this orientation is particularly preferred for the tweeter and mid-range loudspeakers, the orientation of the sub-woofers is not particularly significant.

The casing 4 also supports two distributed mode loudspeakers 220 and 222 which are positioned horizontally so as to radiate sound upwardly and downwardly. By way of example, the panels of the distributed mode loudspeakers 220, 222 might measure 700×500 mm each.

It should be understood that the positioning of the loudspeakers shown in FIG. 9, with the conventional loudspeakers grouped near to the keyboard and the distributed mode loudspeakers remote from the keyboard, is merely exemplary. The conventional and distributed mode loudspeakers may alternatively be interleaved with each other or the positions reversed relative to that shown in the drawing. Also, the tweeters, mid-range units and sub-woofers of the conventional loudspeaker assemblies may be separated and interleaved with the distributed mode loudspeakers.

In this embodiment, when the piano is played, the distributed mode loudspeakers and the conventional loudspeakers are driven simultaneously. As a result, the different air disturbance patterns which are propagated respectively by distributed mode loudspeakers and conventional cone loudspeakers combine to produce air disturbance patterns having a complexity and richness, arising from randomly varying interactions between the different patterns, to provide a substantially richer sound than could be produced by either type of loudspeaker individually. As will be described with reference to FIG. 10, this richness in the third embodiment is further enhanced in that the signals used for driving the distributed mode loudspeakers differ from those used for driving the conventional loudspeakers.

Figures 10, 10A, 10B:
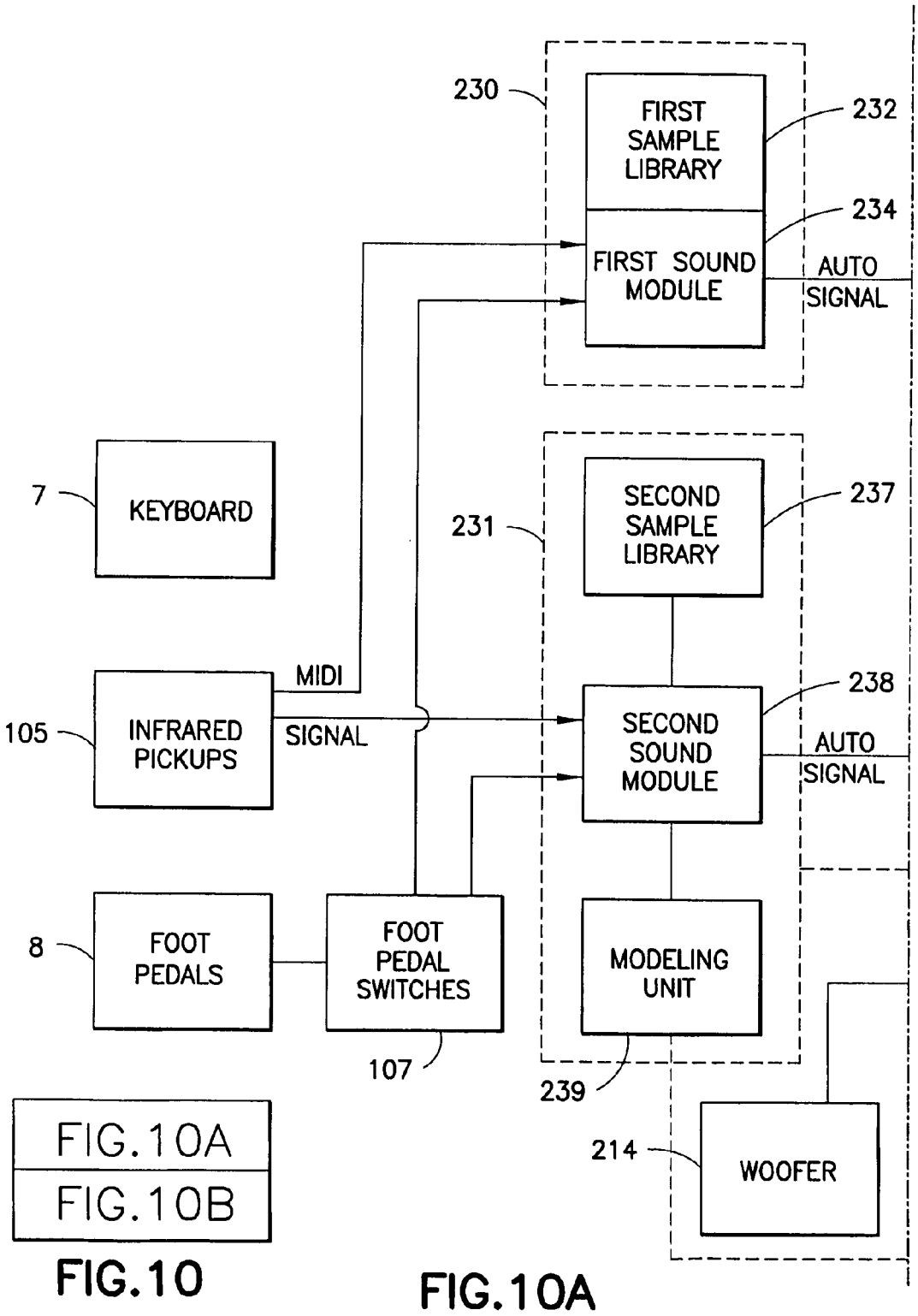
FIG. 10 is schematic block diagram of the piano of FIG. 9.
Figure 10B:
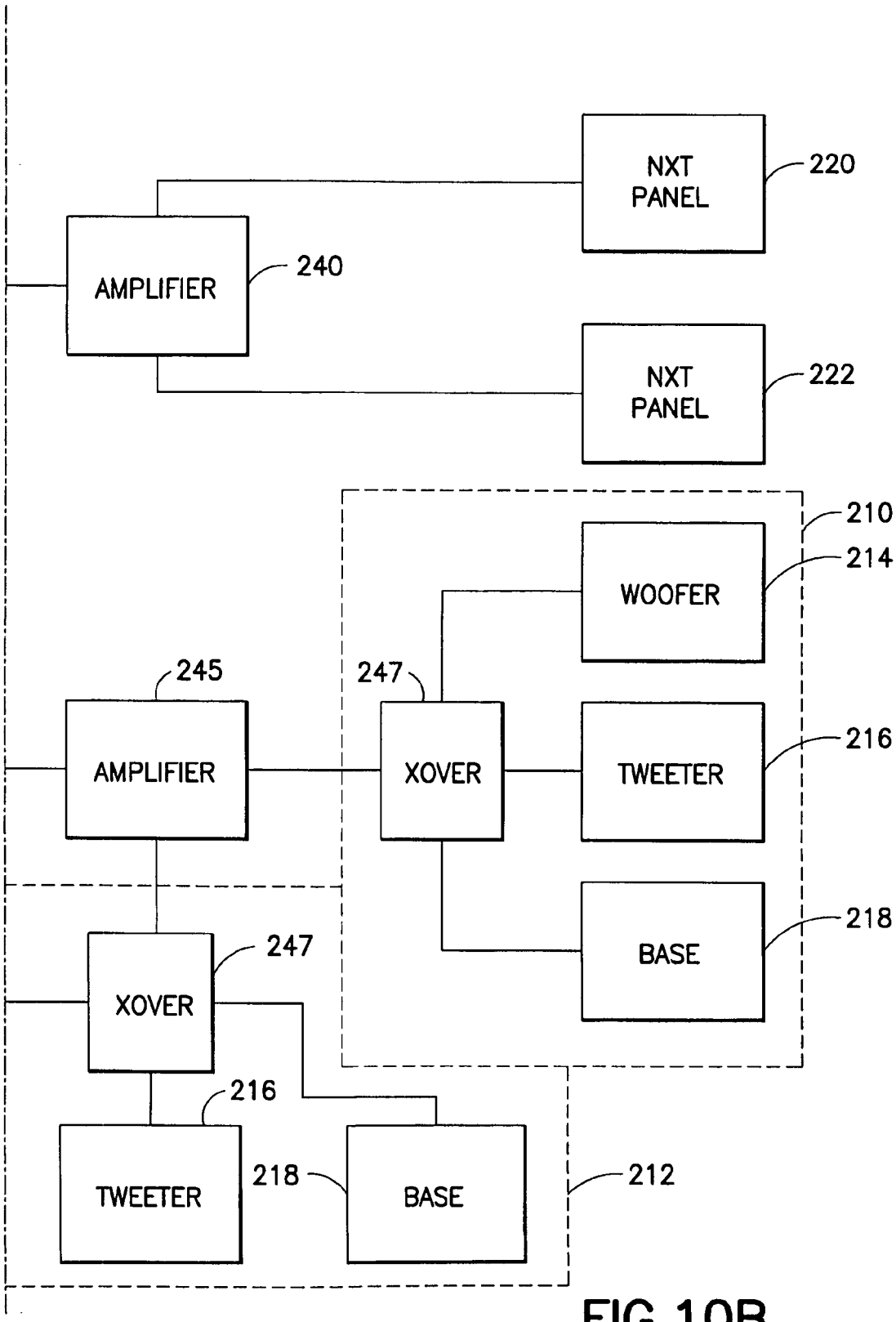

As shown in FIG. 10, signals from foot pedal switches 107 and a midi signal from the infrared pickups 105 arranged beneath the keyboard 7 of the piano are passed to a computer which generates audio signals. In this embodiment, the computer 106 contains software which provides a first sound generation unit 230 and a second sound generation unit 231 both arranged to respond to signals from the infrared pickups 105 and the foot pedal switches 107.

The first sound generation unit 230 in this embodiment comprises a first high quality sample library 232 and a first sound module 234. The second sound generation unit comprises a second high quality sample library 237, a second sound module 238 and a physical modelling unit 239 The respective libraries 232 and 237 comprise digital samples recorded from sound of different high quality grand pianos preferably concert grand. Thus for example the first sound sample library 232 might comprise a 1.6 Gb Steinway sample library and the second sample library 237 might comprise a Yamaha 30 Mb sample sound library The sound modules 234, 238 comprise software programs for selecting sound samples from the sound libraries 232, 237 in response to received midi signals and signals from the foot pedal switches 107. In the case of the second sound generation unit 231 as the second sample library 237 is significantly smaller than the first sample library 232, the second sound generation unit 231 also includes a physical modelling unit 239 arranged to modify sound samples selected by the second sound module 238 from the second sound sample library 237 in response to received midi signals to improve the audio signal in a conventional manner.

In use when a midi signal and signals from the foot pedal switches 107 are received by the first and second sound generation units 230, 231 the first sound module 232 processes the received signals to select a recorded sample from the first sample library 231 and outputs a corresponding audio signal via an amplifier 240 to the two distributed mode loudspeaker 220, 222.

Simultaneously the second sound module 238 processes the received midi signals and signals from the foot pedal switches 107 and selects an appropriate sound sample from the second sound sample library 237. The selected sample is then modified utilising the physical modelling unit. The modified version of the selected sample from the second sample library 237 is then passed via an amplifier 245 to the crossover units 247 of the two conventional speakers 210, 212. The crossover units 247 in a conventional manner, then select portions of the audio signal received from the amplifier 245 and pass high frequency, mid range and low frequency signals to the tweeter 216, woofer 214 and base 218 of the conventional speakers 212, 214 respectively which then output sound The first sound generation unit 230 causes sound to be output corresponding to one piano and the second sound generation unit 231 causes sound to be output corresponding to a different piano, as the recordings stored within the sound libraries 232, 237 of the two sound generation units 230, 231 correspond to different instruments. Thus, the audio signals generated by the two sound generation units 230, 231 will differ from one another by how sounds for the same notes are represented in terms of their audible qualities and behaviour (e.g. how rapidly they decay after attack in response etc).

Although in this embodiment two signals are generated representing a note played on the keyboard, in other embodiments, the enhanced enrichment of harmonies could be achieved by generating three or more signals representing sound output by three or more different pianos.

Fourth Embodiment

Figure 11:
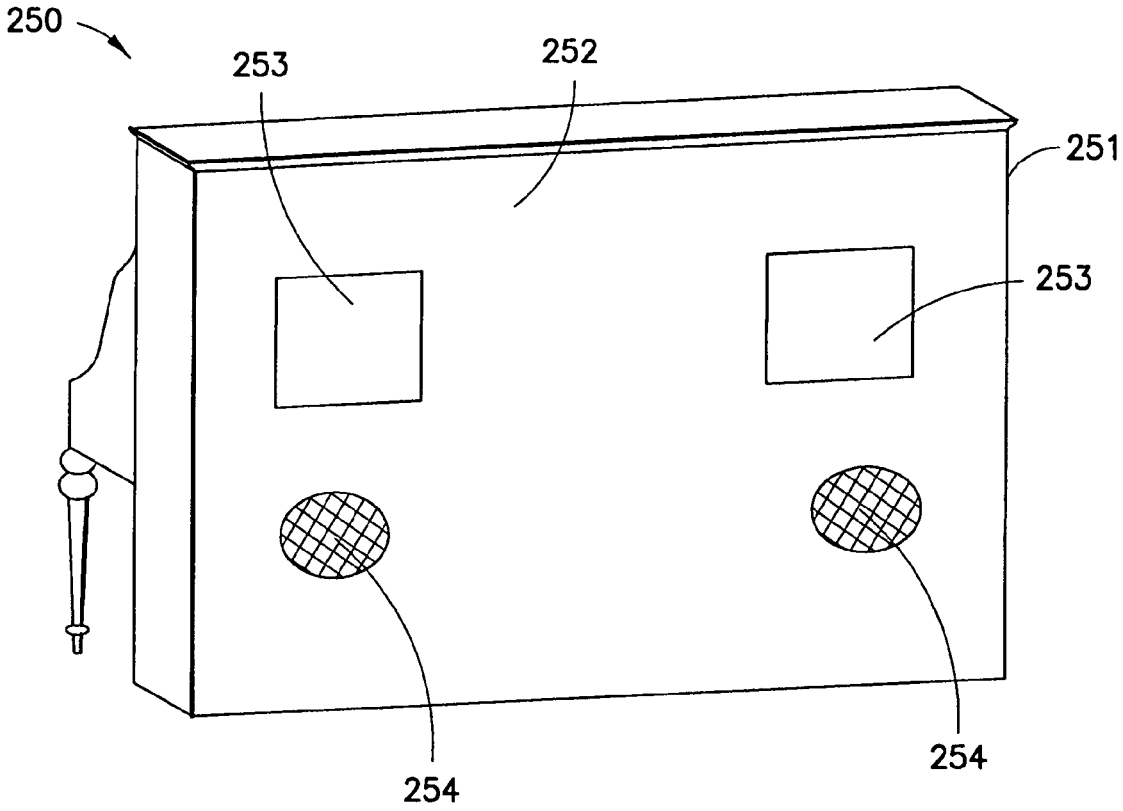
FIG. 11 is a rear perspective view of a digital piano in accordance with a fourth embodiment of the present invention.

FIG. 11 is a schematic perspective view of a piano 250 in accordance with a fourth embodiment of the present invention. Although in the previous embodiments, digital pianos have been described which are arranged in the form of grand pianos, in this embodiment the piano 250 is arranged in the form of an upright piano.

As in the first embodiment the piano 250 comprises a casing 251 which is shaped in the form of a conventional acoustic instrument, in this case a conventional acoustic upright piano. On the back panel 252 of the casing 251 are provided a pair of distributed mode loudspeakers 253 and also a pair of conventional cone loudspeakers 254. In this embodiment in contrast to the previous embodiment only two cone loudspeakers are provided with appropriate frequency ranges, in order to reduce cost. The piano of this embodiment would not therefore have the full frequency range of the piano of the previous embodiment. If a fuller frequency range were desired more conventional cone speakers of different sizes could be provided. The distributed mode loudspeakers 253 are provided oriented parallel to the plane of the back panel 252 of the casing 251. The cones of the two conventional speakers 254 are oriented with the axis of the cone perpendicular to the plane of the back panel 252.

As in the previous embodiment the distributed mode loudspeakers 253 and conventional loudspeakers 254 are arranged so as to be activated simultaneously in response to depression of the keys on the keyboard (not shown in FIG. 11) so that the electronic piano is caused to create an air disturbance pattern which is the combination of sound output by the distributed mode loudspeaker 253 and the conventional loudspeakers 254.

Figure 12:
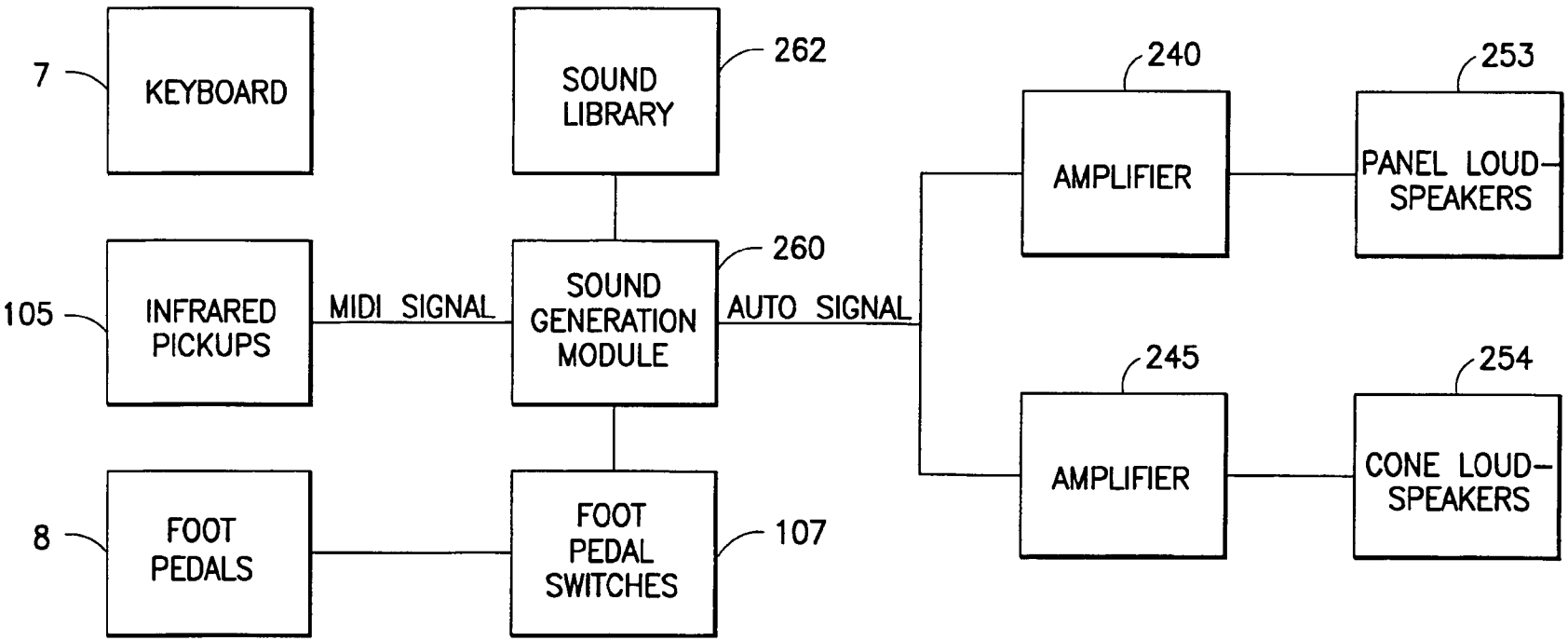
FIG. 12 is a block diagram of the piano of FIG. 11.

FIG. 12 is a schematic block diagram of the piano of FIG. 11. In contrast to the previous embodiment a single sound generation unit 260 is connected to a single sound library 262. The sound generation unit 260 is arranged to respond to signals via the infrared pickups 105 beneath the keyboard 7 and from the foot pedals 8 via foot pedal switches 107. The sound generation unit 260 then generates an audio signal using the sound library 262 on the basis of the received signals from the infrared pickups 105 and foot pedal switches 107. The generated audio signal is then passed via amplifiers 240, 245 to the panel loudspeakers 253 and the conventional cone loudspeakers 254. When sound is output by the speakers 253, 254, the air disturbance patterns generated from the two different types of speaker interfere with one another thereby more closely emulating the propagation of sound generated by an acoustic instrument as explained above.

In this embodiment, the same signal is utilised to activate both the panel loudspeakers 253 and the cone loudspeakers 254. Even though the same driving signal is utilised by both of the loudspeakers, because of the different manner in which distributed mode loudspeakers and cone loudspeakers propagate sound, the air disturbance patterns will differ from one another and will interfere in the air in a random manner giving the impression of the sound from an acoustic instrument.

Fifth Embodiment

Figure 13:
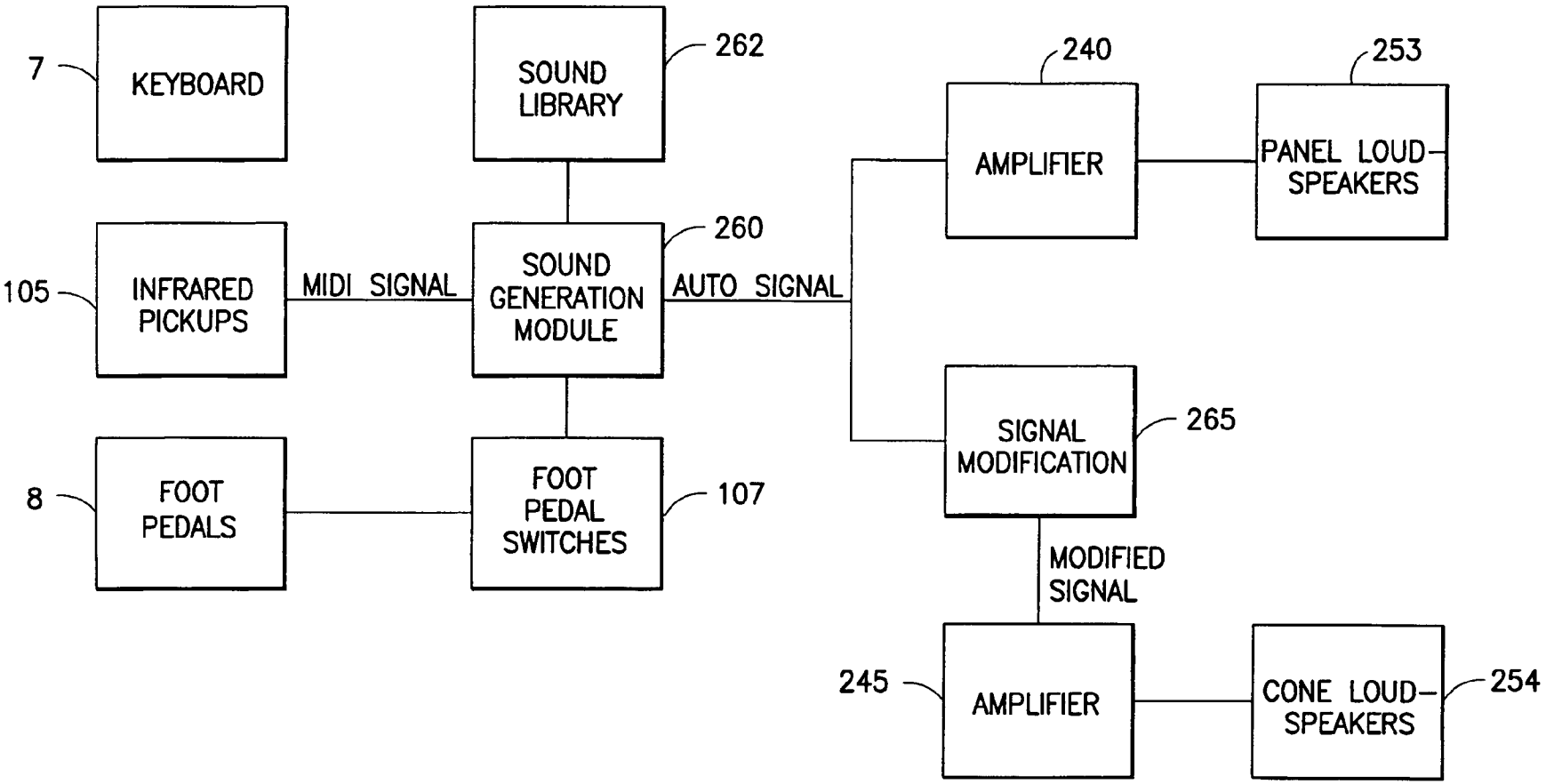
FIG. 13 is a block diagram of a digital piano in accordance with a fifth embodiment of the present invention.

A fifth embodiment of the present invention will now be described. FIG. 13 is a schematic block diagram in accordance with this embodiment of the present invention. In this embodiment, which is substantially similar to the previous embodiment a computer containing software providing a sound generation module 260 and a sound library 262 arranged to generate an audio signal in response to the receipt of signals from infrared switches 105 and foot pedal switches 107. However, in contrast to the previous embodiment instead of identical signals being passed via amplifiers 240–245 to the panel loudspeakers 253–254, in this embodiment the generated audio signals from the sound generation unit 260 is passed to the amplifier 240 connected to the panel loudspeaker 253. However, the audio signal generated by the sound generation unit 260 is passed to a signal modification unit 265 such as a digital signal processing unit, which generates a modified signal that is passed to the amplifier 245 connected to the cone loudspeakers 254. The signal modification unit 265 in this embodiment is arranged to alter the timing and timbre of the audio signal output by the sound generation unit 260. This signal modification unit 265 includes a conventional user interface (not shown) which enables a user to select the manner in which signals output by the sound generation unit 260 are modified. The modified signals are then utilised to activate the conventional cone loudspeakers 254. Such a signal modifying unit could of course be provided for modifying the signals to all loudspeakers.

Although in the previous three embodiments, sound has been described as being output through pairs of flat panel loudspeakers and pairs of conventional loudspeakers, it will be appreciated that the same random mixing of air disturbance patterns could be achieved by outputting sound simultaneously corresponding to the same notes through a single panel speaker and a single cone loudspeaker. It will be also appreciated that although in the previous embodiment the loudspeakers have been described as being oriented so as to output sound in an orientation similar to the orientations of the soundboards of a grand or upright piano, other orientations of loudspeaker could be used.

Although in previous embodiments panels have been described comprising a shaped honeycomb structure to which fibreglass skins are attached other forms of panel could be used. Instead of a honeycomb structure a panel comprising a lightweight foam core could be used as could any other lightweight support structure which enables a pair of skins to be separated from each other creating a stiff rigid panel. A panel could be shaped in the manner previously described or alternatively a flat panel could be used.

Although in previous embodiments a panel has been described which is clamped at its periphery to a casing and placed in horizontal compression, a panel for outputting sound by resonant vibrations could be held in position by other means. For example, a number of supports could be provided to support a panel from underneath without the periphery of the panel being clamped or the panel being placed under horizontal compression. If a panel is to be supported from below, preferably the supports are arranged to support the panel at points on its surface corresponding to antinodes when the panel is excited to vibrate at frequencies corresponding to frequencies of notes of a grand piano to minimise the influence of such supports from preventing the surface of the panel from vibrating.

Although in previous embodiments a motion detection system for detecting the motion of keys has been described utilizing infrared motion detection, other means may be used to detect the depression keys for example an electromechanical motion detection system could be used to detect the position, pressure and velocity of key activation.

In FIG. 7, the infrared pick-ups 105 are used to generate a MIDI signal which is separate from the output of the foot pedals 6. Alternatively, the foot pedals 6 and infrared pick ups 105 may be connected to the computer 100 via the same interface so that the MIDI signal includes the foot pedal control signals.

Although in the previous embodiments a sound generation system has been described in which sound samples are selected from a number of sound samples stored within a hard disc, sound samples for an electronic piano in accordance with the present invention could be generated in other ways. For example a recorded sample could be modified to generate different notes of different pitch rather than having individual notes stored separately on a hard disc. The recording of sound samples may either be based on a conventional recording of the sound of a grand piano or alternatively individual drive signals could be selected where the drive signals are recorded utilizing recordings of sound generated at a point on the sound board corresponding to the position of a transducer which is to be driven by a recorded drive signal.

Although in previous embodiments pianos have been described which output sound via a panel by electromagnetic transducers arranged underneath or within a panel other arrangement of transducers could be used, for example transducers could be arranged on the upper surface of a panel or alternatively a combination of positions of transducers on the upper and lower surfaces of a panel or within a panel could be used.

Although in the previous embodiments pianos have been described which generate sound on the basis of detected key actuations, pianos of the present invention could generate sound on the basis of prerecorded MIDI files in order to recreate a recorded performance in a manner a of a player piano Alternatively a piano in accordance with the present invention could have means for recording a performance detected and converted into a MIDI file for later playback.

Although in the previous embodiments pianos have been described which output sound via a panel excited by electromagnetic transducers, other forms of distributed mode acoustic resonators could be used. For example a panel having multiple piezoelectric transducers on its surface could be used. In such a case a processor could be required to process the output audio sound signals to create a multiple drive signals which excite respective piezoelectric drivers in a pseudo random manner to entrance the distributed mode of vibration. Another alternative means for providing sound which emanates from an area rather than from a point source would be to provide a Quad electrostatic loudspeaker arranged to be excited electrostatically across the surface of its sound producing diaphragm.

Although in previous embodiments a single sound source has been provided which is arranged to generate sound across the entirety of the area ordinarily occupied within a conventional grand piano by the sound board and harp, two or more panels could be provided for generating sound. The planar extent of the base of the soundbox could therefore be divided into a number of separate regions occupied by respective panels. The panels could be separately energised according to the musical notes being played to achieve enhanced spatial realism similar to the effect described with reference to FIG. 9.

Furthermore, panels for generating sound could form part of the casing or lid of a piano. Alternatively portions of the casing could be directly excited by transducers causing resonant vibrations. In this way the casing and lid or portions of the casing and lid could directly act as the sound board for the digital piano and there being no need to provide separate panel which is carried within the casing. In such an embodiment it would be necessary for the casing and lid or portions of the casing and lid to be made of a material, such as carbon fibre, which can both be excited by transducers to cause bending mode vibrations and which has sufficient strength to enable the casing on the lid to perform the standard functions of a casing and lid of a conventional acoustic grand piano.

Each of the above embodiments may additionally include an effects processor, as an adjunct to the amplifier 108, having the facility to vary volume, equalisation and reverberation to enable the user to adjust the sound to his own taste.

Additional functionality of the instrument may be provided by other effects such as chorus, to obtain sounds not available from a conventional grand piano.

Other effects could also be created by modifying the sound of recorded samples. Also, alternative sound sources other than a grand piano could be recorded and used to generate for example the sound of a harpsichord, Fender Rhodes piano or a vibraphone.

Alternatively synthesised sounds could be used as the basis for generating drive signals for a panel in accordance with the present invention.

Furthermore in accordance with the present invention the amplifier 106 and panel 1 could be used to output sounds other than those generated in response to actuation of the keyboard. For example, the orchestral score for backing a piano piece could be played from either a midi file or CD and output through a panel whilst piano sounds played on the basis of detected depression of keys and pedals are output.

The air disturbance patterns produced by distributed mode loudspeakers are described in "NXT—A Technical Overview" by Henry Azima published by NXT—New Transducers Ltd 2000, the contents of which are incorporated herein by reference.

What is claimed is:

1. In a digital piano having a keyboard, pedals, and a signal generator responsive to activation of the keyboard and the pedals to generate control signals representative of said activation, the improvement comprising:

a first library which comprises digital samples representative of sound from a first model of grand piano;

a first driving circuit responsive to said control signals to produce a first driving signal which represents said activation and which is derived from said digital samples of said first library;

a second library which comprises digital samples representative of sound from a second model of grand piano;

a second driving circuit responsive to said control signals to produce a second driving signal which represents said activation and which is derived from said digital samples of said second library, said first and second driving circuits producing said respective first and second driving signals simultaneously;

at least one distributed mode loudspeaker arranged to be driven by said first driving signals; and at least one cone loudspeaker arranged to be driven by said second driving signals.

2. A digital electronic piano comprising:

a keyboard comprising a plurality of keys corresponding to musical notes;

a signal generator operable in response to actuation of each of said plurality of keys to generate first and second driving signals each representing a piano sound corresponding to the actuated key, said signal generator comprising first and second libraries of digital samples of piano sounds from which said first and second driving signals are derived, the digital samples of said first library differing from the digital samples of said second library such that said first and second driving signals represent piano sounds having respective different audible qualities;

at least one distributed mode loudspeaker arranged to be driven by said first driving signal; and at least one pistonic loudspeaker arranged to be driven by said second driving signal.

3. A digital electronic piano according to claim 2, wherein said at least one pistonic loudspeaker is a cone loudspeaker.

* * * * *